US007045025B2

(12) United States Patent
Hamamura et al.

(10) Patent No.: US 7,045,025 B2
(45) Date of Patent: May 16, 2006

(54) GRAIN-ORIENTED ELECTRICAL STEEL SHEET EXCELLENT IN MAGNETIC PROPERTIES AND METHOD FOR PRODUCING THE SAME

(75) Inventors: Hideyuki Hamamura, Futtsu (JP); Tatsuhiko Sakai, Futtsu (JP); Naoya Hamada, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 323 days.

(21) Appl. No.: 10/448,754

(22) Filed: May 30, 2003

(65) Prior Publication Data

US 2004/0040629 A1 Mar. 4, 2004

(30) Foreign Application Priority Data

May 31, 2002 (JP) ..... 2002-159823
Apr. 14, 2003 (JP) ..... 2003-109227

(51) Int. Cl.
*H01F 1/153* (2006.01)

(52) U.S. Cl. ..... 148/308; 148/306; 148/111; 148/112; 148/113

(58) Field of Classification Search ..... 148/110, 148/111, 112, 113, 306, 308
See application file for complete search history.

(56) References Cited

U.S. PATENT DOCUMENTS

| | | | | |
|---|---|---|---|---|
| 4,613,842 | A | 9/1986 | Ichiyama et al. | |
| 4,750,949 | A | 6/1988 | Kobayashi et al. | |
| 4,780,155 | A * | 10/1988 | Salsgiver et al. | 148/111 |
| 5,665,455 | A * | 9/1997 | Sato et al. | 428/167 |
| 6,368,424 | B1 | 4/2002 | Sakai et al. | 148/111 |
| 6,482,271 | B1 * | 11/2002 | Sakai et al. | 148/111 |

FOREIGN PATENT DOCUMENTS

| | | |
|---|---|---|
| EP | 0161593 | 11/1985 |
| EP | 0331498 | 6/1989 |
| EP | 0870843 | 10/1998 |
| EP | 0992591 | 12/2000 |
| JP | 6344804 | 9/1988 |
| JP | 6212275 | 8/1994 |
| JP | 7220913 | 8/1995 |
| JP | 7-331333 | * 12/1995 |

OTHER PUBLICATIONS

Eorpean Search Report Application No. 0301166, dated Sep. 26, 2003.
Japanese Unexamined Patent Publcation No. 2000-109961, published Apr. 18, 2000.

* cited by examiner

*Primary Examiner*—John P. Sheehan
(74) *Attorney, Agent, or Firm*—Baker Botts L.L.P.

(57) ABSTRACT

A low core loss grain-oriented electrical steel sheet that does not have a significant deterioration in a magnetic flux density and a decrease of a space factor, and which may withstand stress-relieving annealing is provided. Melted and re-solidified layers can be formed on either or both of the surfaces of the grain-oriented electrical steel sheet that extend in a direction that is perpendicular to the rolling direction (e.g., in the direction of the width thereof), at a cyclic interval of not less than approximately 2 mm to less than approximately 5 mm in the rolling direction. The melted and re-solidified layers may be provided on each surface of the grain-oriented electrical steel sheet, and can have an aspect ratio that is a ratio of the depth to the width of the melted and re-solidified layer of not less than approximately 0.20 and a depth of not less than approximately 15 μm. In addition, the melted and re-solidified layers can be formed by using a laser.

6 Claims, 7 Drawing Sheets

ASPECT RATIO OF MELTED AND RE-SOLIDIFIED LAYER=d/W

GRAIN-ORIENTED ELECTRICAL STEEL SHEET EXCELLENT IN MAGNETIC PROPERTIES AND METHOD FOR PRODUCING THE SAME

CROSS-REFERENCE TO RELATED APPLICATIONS

The present application claims priority under 35 U.S.C. § 119 from Japanese Patent Application No. 2002-159823 filed on May 31, 2002, and Japanese Patent Application No. 2003-109227 filed on Apr. 14, 2003, the entire disclosures of which are incorporated herein by reference.

FIELD OF THE INVENTION

The present invention relates to a grain-oriented electrical steel sheet which can withstand stress-relieving annealing, having predetermined magnetic properties and being usable for a wound magnetic core, and to a method for producing the grain-oriented electrical steel sheet by applying laser processing to either or both of the surfaces of the grain-oriented electrical steel sheet and, by so doing, forming melted and re-solidified layers thereon.

BACKGROUND INFORMATION

It is generally preferable to lower the core loss of a grain-oriented electrical steel sheet, from a point of energy conservation. Japanese Patent Publication No. S58-26405 describes a method for lowering core loss, in which magnetic domains are fractionalized by laser irradiation. This method aims to achieve a lower core loss by introducing a stress strain to a grain-oriented electrical steel sheet by the reactive force of thermal shock waves generated by the irradiation of a laser beam, and thus by fractionalizing magnetic domains. However, a potential problem of such method is that the strain introduced by the laser irradiation disappears during annealing, and therefore the effect of fractionalizing the magnetic domains is significantly reduced, or even lost. Therefore, even though this method may be applied to a grain-oriented electrical steel sheet for a laminated core transformer which does not require stress-relieving annealing, it is generally not applicable to a steel sheet for a wound core transformer that requires stress-relieving annealing.

In order to improve the core loss of a grain-oriented electrical steel sheet by enabling the effect of lowering core loss to be retained even after stress-relieving annealing, various conventional methods have been provided in which a deformation exceeding a stress strain level may be imposed on a steel sheet, whereby the magnetic permeability thereof can be changed and, by so doing, the magnetic domains can be fractionalized. Such methods may include a method with which groove-shaped or pit-shaped concaves may be formed on the surface of a steel sheet by pressing the steel sheet with a tooth roll (as described in Japanese Patent Publication No. S63-44804); a method in which concaves may be formed on the surface of a steel sheet by chemical etching (as described in U.S. Pat. No. 4,750,949); and a method in which grooves comprising the lines of pits may be formed on the surface of a steel sheet with a Q-switched $CO_2$ laser (as described in Japanese Patent Publication No. H7-220913). Another example of such method is one in which instead of grooves, melted and re-solidified layers may be formed on the surface of a steel sheet with a laser (refer to Japanese Patent Publication Nos. 2000-109961 and H6-212275).

Some of the problems of the conventional methods mentioned above are that, e.g., (i) in the case of the mechanical-type method in which a tooth roll is used, maintenance is need to be performed frequently because the electrical steel sheet is hard, and thus the teeth of the roll may likely be worn away in a short span of time; (ii) in the case of the method in which chemical etching is employed, while it may not have the problem of the wear of the teeth, the steps of masking, etching and removing the mask are needed, and thus these processes are more complicated than a mechanical method; (iii) in the case of the method in which grooves that include lines of pits are formed on the surface of a steel sheet with a Q-switched $CO_2$ laser, though such method does not have the problem of the wear of the teeth or the complication of previously described processes (because the concaves are formed in a non-contact manner), a special Q-switching device should be added separately to a commercially available laser oscillator; (iv) in the case of the method with which grooves are formed, because some parts of the steel sheet are removed, the space factor thereof is likely lowered, thus adversely influencing the performance of a transformer; and, (iv) in the case of the method with which melted and re-solidified layers are formed, though the lowering of a space factor is either reduced or eliminated, core loss is not sufficiently improved.

The entire disclosures of the referenced publications are incorporated herein by reference.

SUMMARY OF THE INVENTION

One of the objects of the present invention is to provide a grain-oriented electrical steel sheet that has an improved core loss of the same rank. Such steel sheet may be a grain-oriented electrical steel sheet having melted and re-solidified layers formed by laser processing and excellent magnetic properties even after being subjected to stress-relieving annealing and a production method thereof. The steel sheet may be produced by a groove-forming method, without suffering from the deterioration in magnetic flux density and the lowering of a space factor. Another object of the present invention is to provide a method for producing the grain-oriented electrical steel sheet.

A grain-oriented electrical steel sheet according to an exemplary embodiment of the present invention is provided. In this exemplary method, melted and re-solidified layers are formed on either or both of the surfaces of the grain-oriented electrical steel sheet in such that such layers extend in the direction of the width thereof at a constant and cyclic interval of not less than 2 mm to less than 5 mm in the direction of rolling. The melted and re-solidified layers on each surface of the grain-oriented electrical steel sheet have an aspect ratio that is the ratio of the depth to the width of a melted and re-solidified layer of not less than 0.20 and a depth of not less than 15 μm.

In particular, it may be preferable for the widths of the melted and re-solidified layers to be in the range from not less than 30 μm to not more than 200 μm.

Another exemplary embodiment of a method for producing a grain-oriented electrical steel sheet according to the present invention is also provided in which a laser beam irradiates either or both of the surfaces of the grain-oriented electrical steel sheet to form melted and re-solidified layers thereon.

According to a further embodiment of the present invention, the melted and re-solidified layers are formed using a laser beam radiated from a continuous oscillation fiber laser utilized as a laser device.

DESCRIPTION OF THE PREFERRED EMBODIMENT

According to an exemplary embodiment of the present invention, a method for improving a core loss is provided. In this method, linear melted and re-solidified layers can be formed on either or both of the surfaces of a grain-oriented electrical steel sheet that extend in the direction that is approximately perpendicular to the rolling direction at a prescribed interval (in the rolling direction) after finish annealing or insulating film coating is applied. Using such method, an improved core loss can be achieved (that exceeds the core loss rate obtained by the conventional melting and re-solidifying method or groove forming method) even after stress-relieving annealing is applied by restricting the aspect ratio, the interval, the depth and the width at a cross section of each melted and re-solidified layer, while the restrictions not being taken into consideration in the existing technologies. Exemplary embodiments of the present invention are explained herein below.

Figure 8:
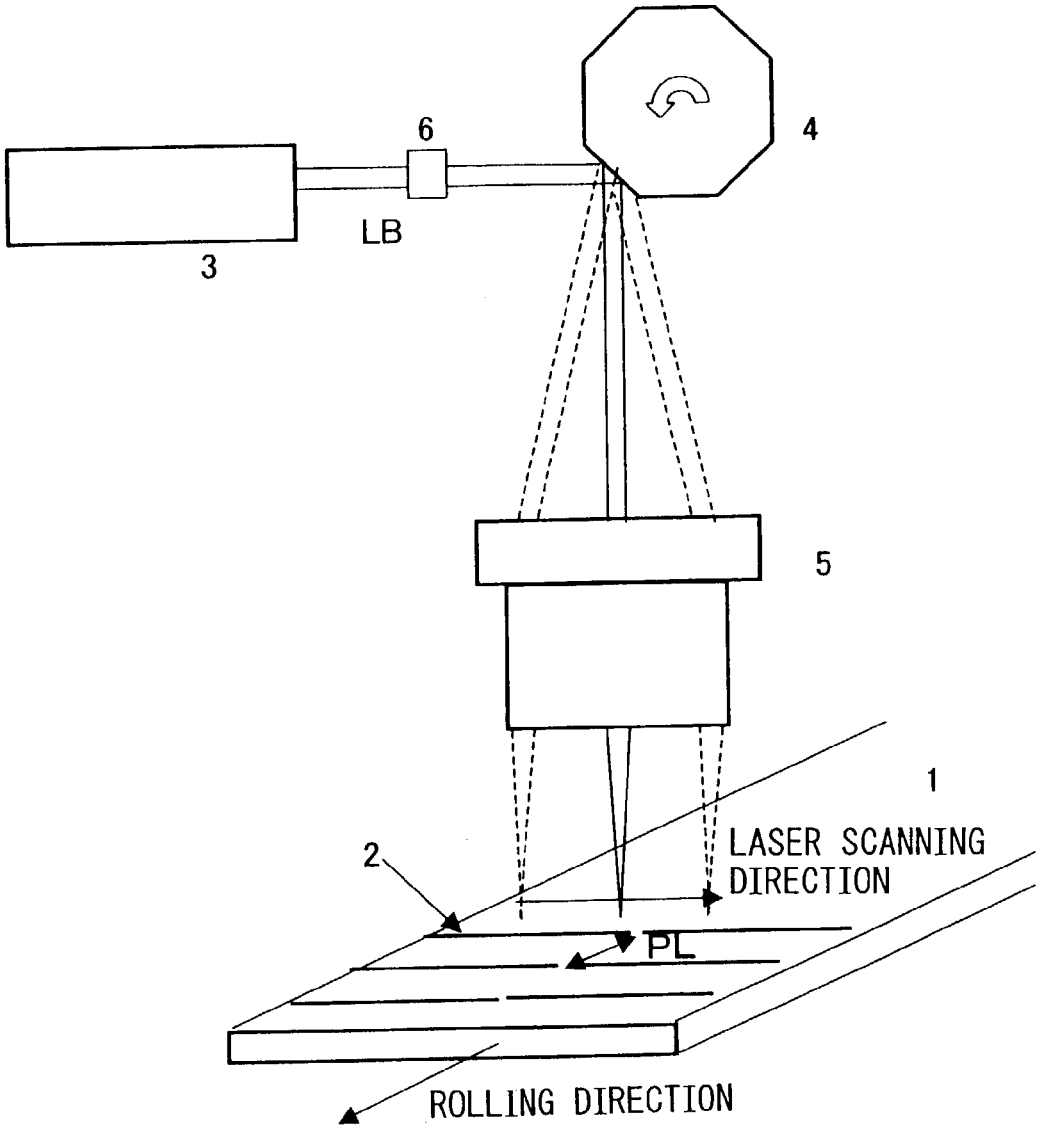
FIG. 8 shows a schematic diagram of an exemplary system that is configured to implement the method for producing the low core loss grain-oriented electrical steel sheet with a laser according to the present invention.

A laser beam irradiation method can be used as a method for forming melted and re-solidified layers and improvement of core loss may be observed. FIG. 8 illustrates a schematic diagram of a system that can be configured to implement the exemplary laser beam irradiation method according to the present invention. In this exemplary system, a laser beam LB originating from a laser device 3 may be irradiated in a scanning manner on a grain-oriented electrical steel sheet 1 using a scanning mirror 4 and an fθ lens 5. A cylindrical lens 6 can be used for converting the shape of a condensed laser beam from a circle shape to an oval shape. Though one unit is shown in FIG. 8, a plurality of similar units may be arranged in a direction of a width of the steel sheet. Further, when both the surfaces of a steel sheet are irradiated, a plurality of similar units may be arranged above and under the steel sheet so that the steel sheet is located between them.

Figure 3:
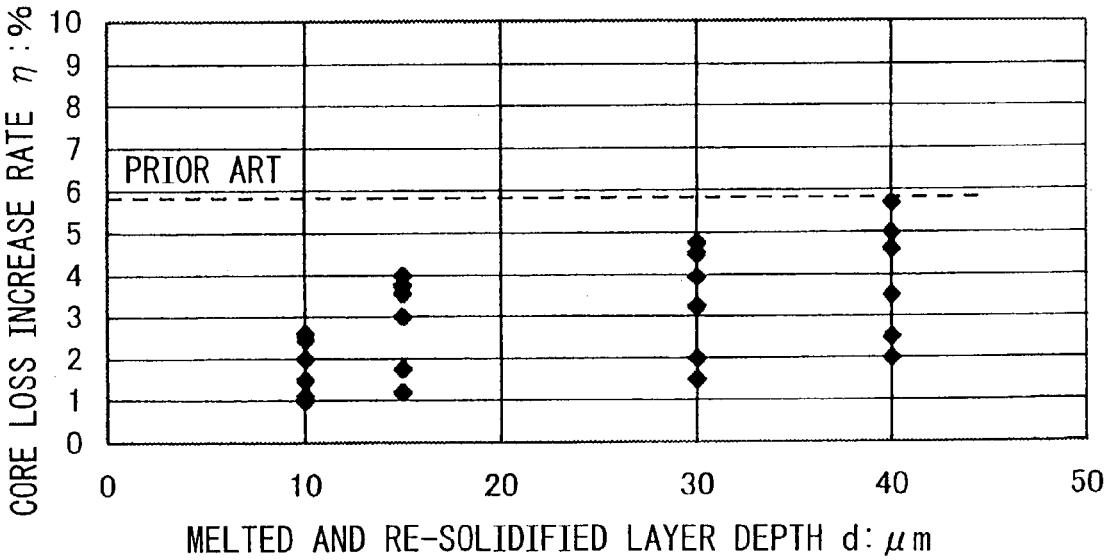
FIG. 3 shows a graph indicating a relation between depths of the melted and re-solidified formed layers and the core loss improvement rates (with the melted and re-solidified layers being formed at an interval of 5 mm in the rolling direction).

Initially, the effect of a magnetic domain control may be reviewed with the interval PL in the rolling direction being 5 mm, using the sectional depth of a melted and re-solidified layer as a parameter. As shown in FIG. 3, the core loss improvement rates η can be at most about 6%, which his approximately the same levels as provided in the cases of the existing groove forming method and melting and re-solidifying method, and the correlation with the depths is scarcely observed.

The improvement rate (%) of a core loss W17/50 (W/kg) can be defined by the following expression:

the core loss improvement rate=(the core loss before laser irradiation−the core loss after laser irradiation)/the core loss before laser irradiation×100.

The core loss after the laser irradiation can be a value measured after a stress-relieving annealing is applied at 800° C. for approximately 4 hours. In this exemplary embodiment, W17/50 may represent the core loss that is measured when the frequency of the laser beam is 50 Hz and the maximum magnetic flux density is 1.7 T.

The mechanism of magnetic domain control in the method for forming melted and re-solidified layers according to the present invention is such that a tension can be created by a residual strain generated at a boundary between the melted and re-solidified layer and the not-melted layer, and thereby magnetic domains may be fractionalized. Thus, the component in the rolling direction of a strain may be increased as the direction of a boundary line of a melted and re-solidified layer toward the depth thereof comes closer to the direction perpendicular to the rolling direction. In addition, the effect of increasing the component in the rolling direction of a strain may penetrate deeper in the sheet thickness direction and a greater effect of fractionalizing magnetic domains can be expected as the depth of a melted and re-solidified layer increase.

Figure 2:
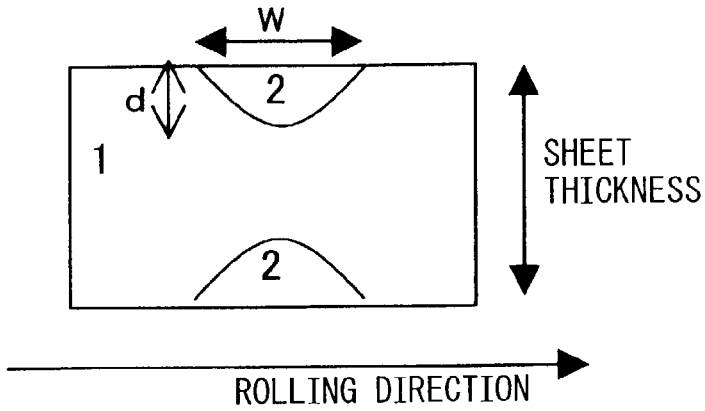
FIG. 2 shows an exemplary sectional illustration of a melted and re-solidified layer formed according to the method of the present invention.
Figure 4:
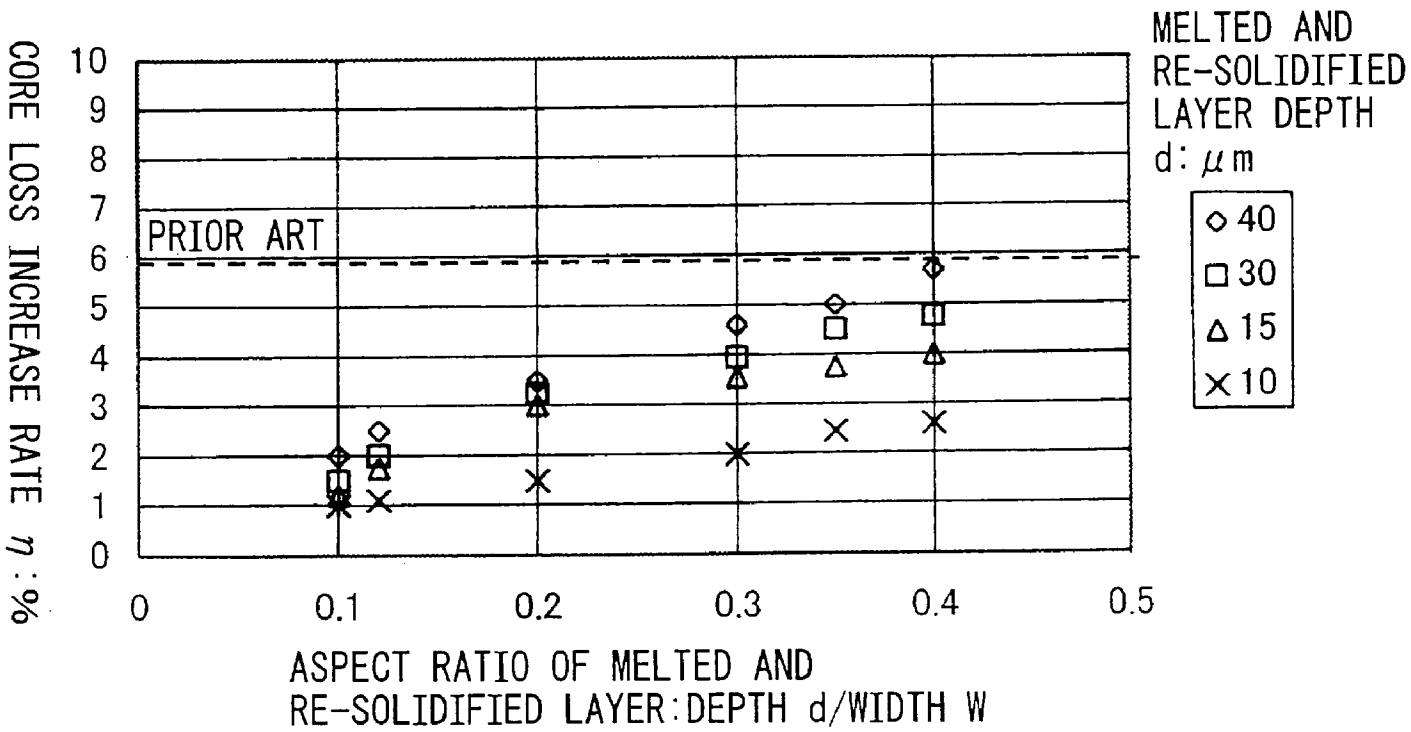
FIG. 4 shows a graph indicating another relation between the aspect ratios at the cross sections of the melted and re-solidified layers and the core loss improvement rates (with the melted and re-solidified layers being formed at an interval of 5 mm in the rolling direction).

A cross section of the melted and re-solidified layer generally can form a semicircle with a laser-irradiated point on a surface being the center thereof. Then, for the purpose of representing the perpendicularity of a boundary line of a melted and re-solidified layer to the rolling direction, an aspect ratio d/W may be defined at a cross section using the depth d and the width W in the rolling direction, e.g., at a cross section of the melted and re-solidified layer, as shown in FIG. 2. By using a sectional aspect ratio (which is a newly developed variable) of the melted and re-solidified layer, the results shown in FIG. 3 may be rearranged as shown in FIG. 4, with the depth d of the melted and re-solidified layer employed as a parameter. As a result of such rearrangement, the core loss improvement rate η can be increased as the sectional aspect ratio of a melted and re-solidified layer can be increased. However, when the depth d is less than 10 μm, the core loss improvement rate η may scarcely increase even if the sectional aspect ratio of a melted and re-solidified layer is increased.

Figure 5:
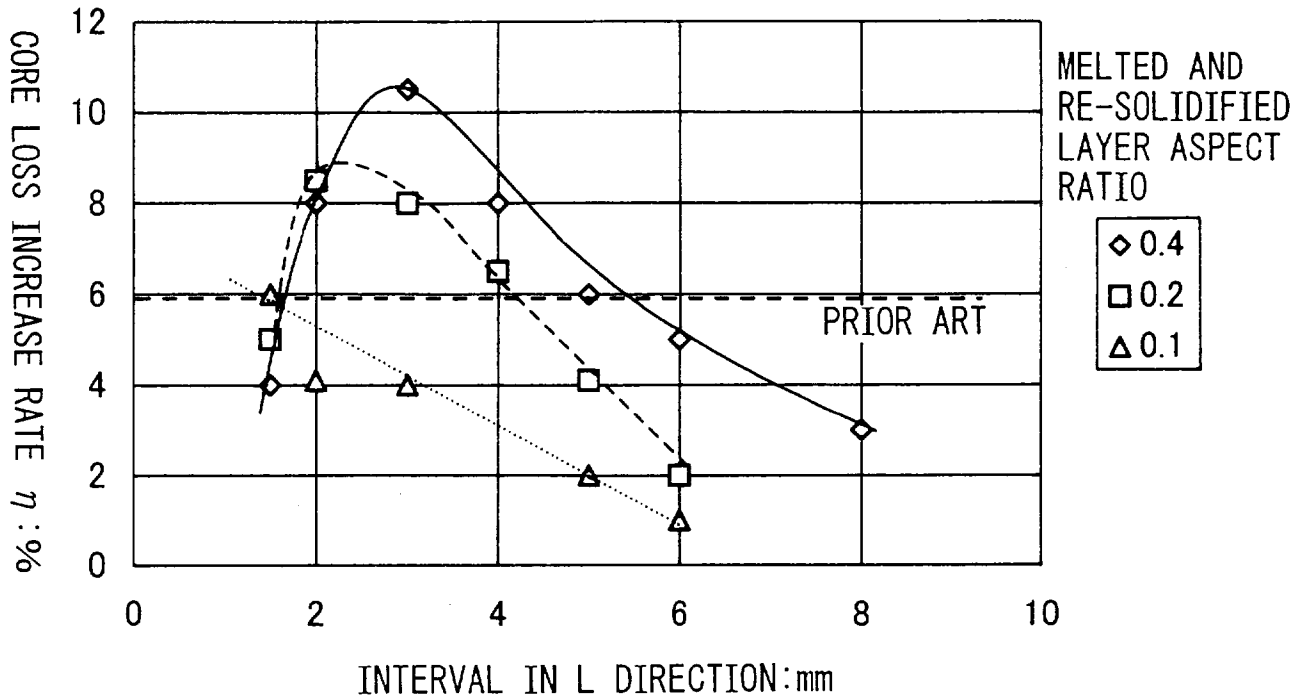
FIG. 5 shows a graph indicating a relation between intervals in the direction of rolling of a steel sheet (e.g., the intervals in the L direction), at which the melted and re-solidified layers are formed, and the core loss improvement rates.

Further, if an interval PL in the rolling direction is decreased, the effect of tension between melted and re-solidified layers in the same direction may synergistically increase. It is possible to use the imposed power and the beam scanning speed fixed, the position where a beam focused varied, namely an aspect ratio varied, and an interval PL in the rolling direction employed as a variable. Then, as shown in FIG. 5, an aspect ratio of approximately not be less than 0.2 and an interval PL in the rolling direction that is in the range from not less than approximately 2 mm to 5 mm can be provided in order to obtain an increased core loss exceeding the loss obtained by the groove forming method or the conventional melted and re-solidified layer method. This may be because, when an interval PL is less than 2 mm, hysteresis loss caused by an inner strain may be larger than eddy current loss increase caused by the effect of melted and re-solidified layers on the fractionalization of magnetic domains and core loss may not be improved as a whole. In addition, when an interval PL is not less than 5 mm, the interaction between adjacent melted and re-solidified layers may be weak, therefore the magnetic domains are generally not fractionalized sufficiently and core loss may not be not improved.

Figure 1:
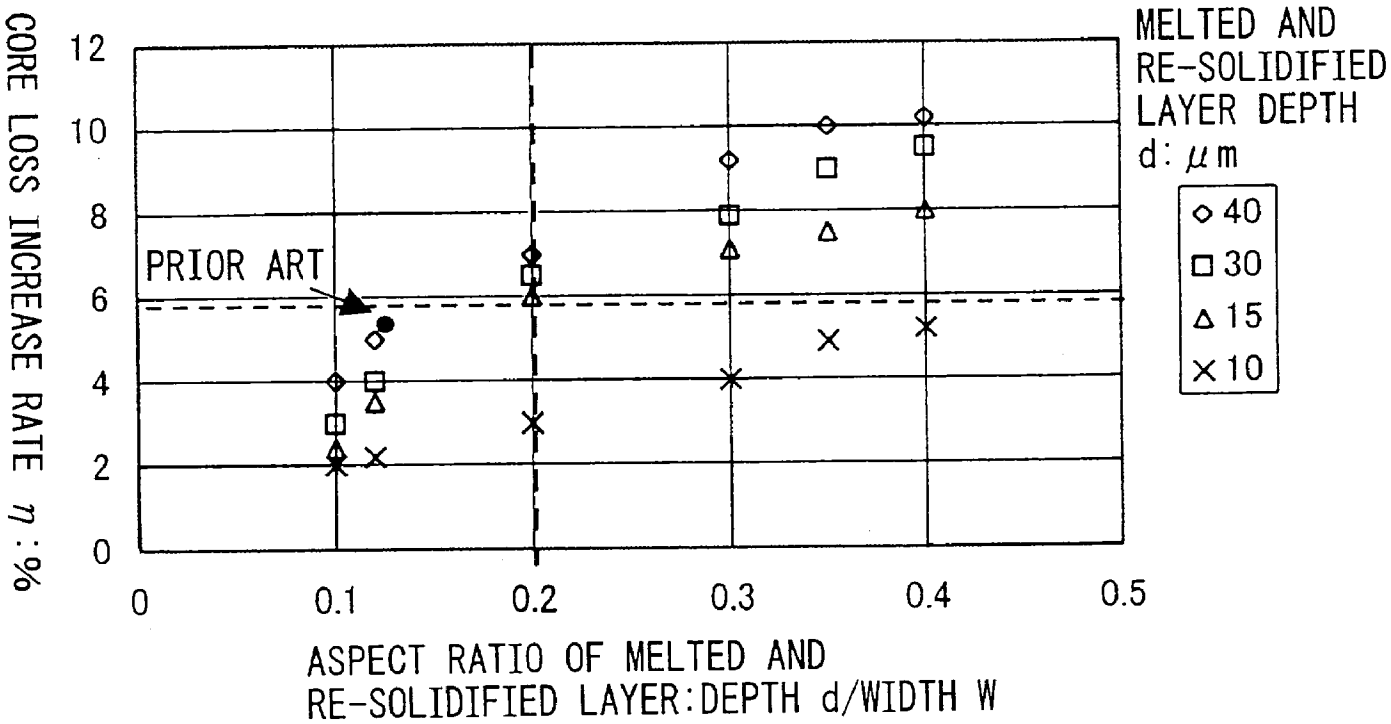
FIG. 1 shows a graph providing a relation between aspect ratios at cross sections of melted and re-solidified formed layers formed and core loss improvement rates in low core loss grain-oriented electrical steel sheets according to an exemplary embodiment of the present invention (with the melted and re-solidified layers being formed on both of the surfaces of each grain-oriented electrical steel sheet at an interval of 3 mm in the rolling direction).

Furthermore, to clarify the depth d utilized by the melted and re-solidified layer, the relation among the core loss improvement rate η, the aspect ratio and a depth d with an interval PL in the rolling direction fixed to the optimum value of 3 mm, the imposed power fixed, and the beam scanning speed and the position at which a beam focused varied can be reviewed. The results of the review are shown in FIG. 1, which illustrates that it may not be necessary to form melted and re-solidified layers having an aspect ratio and a melting depth larger than certain values so as to assuredly obtain a strain or a tension that may have the origin of the effect of the fractionalization of magnetic domains. An improved core loss exceeding one obtained by the groove forming method or the conventional melted and re-solidified layer method can be obtained by the forming melted and re-solidified layers having an aspect ratio of not less than approximately 0.2 and a melting depth d of not less than approximately 15 μm. In addition, a core loss improvement rate η is expressed by the mark • in FIG. 1 as a comparative example, with the core loss improvement rate being obtained by forming melted and re-solidified layers 12 μm, for example, 5% of the sheet thickness 0.23 mm, in depth and 100 μm in width. This means that the aspect ratio is 0.12, on both top and bottom surfaces at an interval of 3 mm, and those conditions corresponding to the conditions described in the embodiments of the above described Japanese Publication Nos. 2000-109961 and H6-212275. Indeed, the core loss can be improved from 0.8 W/kg before laser processing to 0.753 W/kg after laser processing and thus the core loss improvement rate may be 6%. Therefore, the core loss may not be improved significantly due to the small values of the aspect ratio and the melting depth.

Figure 6:
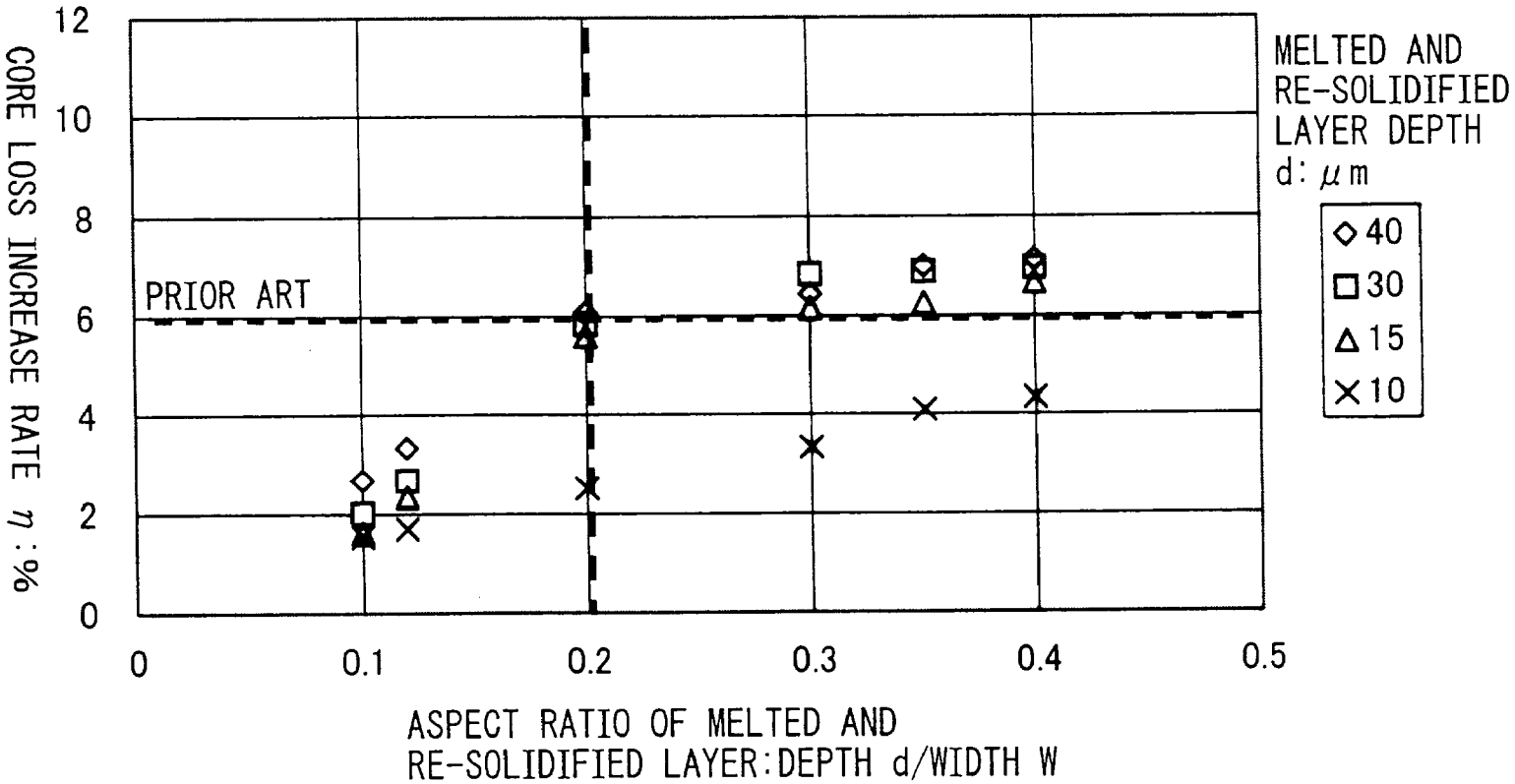
FIG. 6 shows a graph indicating a relation between the aspect ratios at the cross sections of the melted and re-solidified formed layers and the core loss improvement rates in the low core loss grain-oriented electrical steel sheets according to an exemplary embodiment of the present invention (in which the melted and re-solidified layers are formed on either of the surfaces of each grain-oriented electrical steel sheet at an interval of 3 mm in the rolling direction).

The above-mentioned exemplary embodiments of the present invention represent cases in which the melted and re-solidified layers are formed on both the top and bottom surfaces of a steel sheet. Another exemplary embodiment of the present invention can be used on the melted and re-solidified layers that are formed on either of the top and bottom surfaces of the steel sheet, the result of which is shown in FIG. 6. As shown in FIG. 6, a core loss improvement rate equal to or exceeding ones obtained with existing technologies can be obtained by forming the melted and re-solidified layers having an aspect ratio of not less than approximately 0.2 and a depth of not less than approximately 15 μm, though the core loss improvement effect may be lower than effect in the case where melted and re-solidified layers are formed on both the surfaces.

Based on the above results, it is preferable to form the melted and re-solidified layers having an aspect ratio of not less than approximately 0.2 and a melted and re-solidified layer depth of not less than approximately 15 μm at an interval of not less than approximately 2 mm to 5 mm in the rolling direction so as to obtain a strain or a tension that is the origin of the effect of the fractionalization of the magnetic domains and to obtain a high core loss improvement rate.

Furthermore, in order to clarify the width W, the depth d and the aspect ratio required of the melted and re-solidified layer, the relation among the core loss improvement rate η, the width W and the depth d with an interval PL in the rolling direction fixed to the optimum value of 3 mm, the imposed power fixed, and the beam scanning speed and the position at which a beam focused varied, using a continuous oscillation fiber laser as a laser device has been determined. The results of the determination are shown in FIG. 7.

The fiber laser can be a laser device in which a fiber core itself radiates with a semiconductor laser that can be used as an excitation source. Such fiber laser can have a high beam quality, since the oscillation beam diameter may be regulated by the diameter of the fiber core, thus being capable of condensing the laser beam up to a minute diameter of several tens of microns, though a practical condensed laser beam diameter of a $CO_2$ laser or the like has been about 100 μm at best. By using such fiber laser, the width of a melted and re-solidified layer may be changed over a wide range from 10 μm to 500 μm. In particular, in order to practically form a melted and re-solidified layer so as to have a width of not more than approximately 100 μm, a fiber laser is the most appropriate manner.

Figure 7:
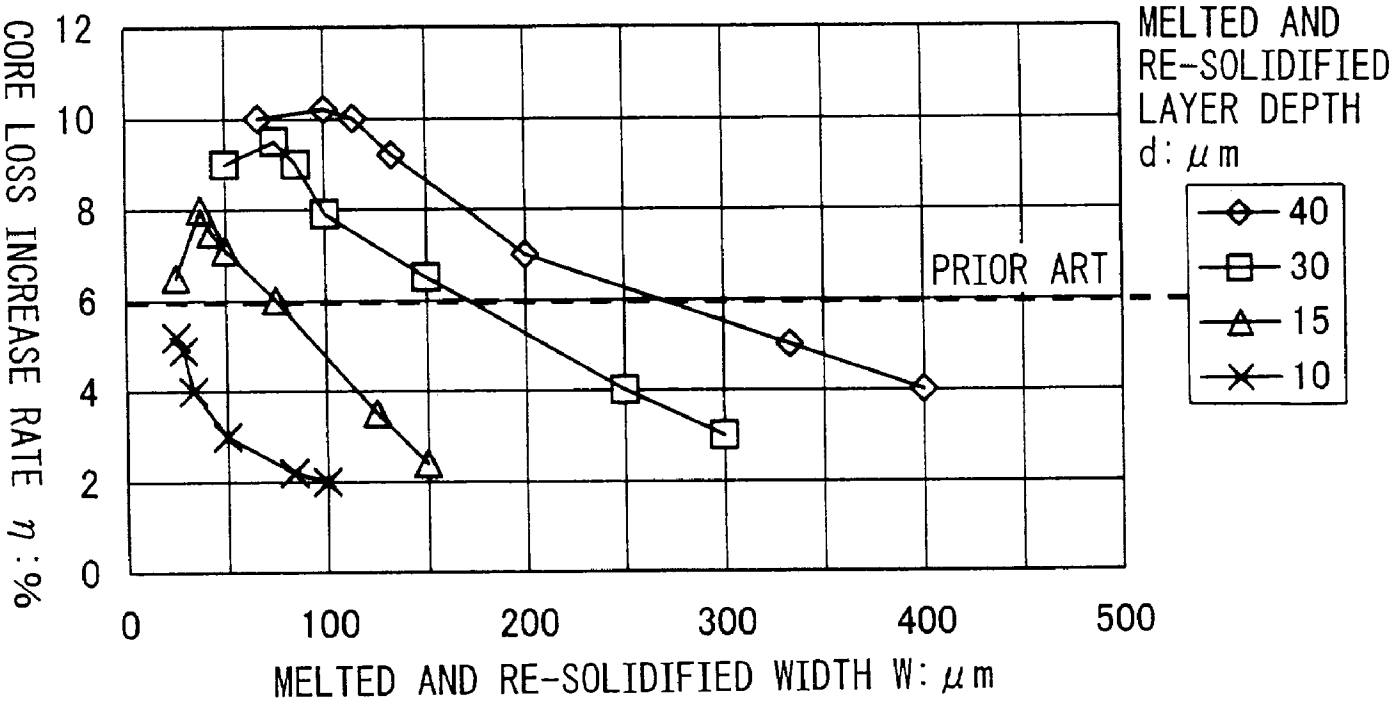
FIG. 7 shows a graph indicating a relation between the widths of the melted and re-solidified formed layers and the core loss improvement rates in the low core loss grain-oriented electrical steel sheets according to an exemplary embodiment of the present invention (with the melted and re-solidified layers being formed at an interval of 3 mm in the rolling direction).

FIG. 7 shows that it is preferable to form the melted and re-solidified layers having a melting width in a particular range and an aspect ratio and a melting depth of not less than particular values so as to obtain a strain or a tension that is the origin of the effect of the fractionalization of magnetic domains. An improved core loss exceeding 6% in terms of the core loss improvement rate, such value being the core loss improvement rate obtained by the groove forming method or the conventional melted and re-solidified layer method, can be obtained by forming the melted and re-solidified layers having a melting width in the range from not less than approximately 30 μm to not more than approximately 200 μm, an aspect ratio of not less than approximately 0.2 and a melting depth d of not less than approximately 15 μm.

When the melting width is less than 30 μm, the interaction between adjacent melted and re-solidified layers may be weak, and therefore magnetic domains are generally not fractionalized sufficiently and core loss may not be improved. On the other hand, when the melting width is more than 200 μm, though a certain degree of the core loss improvement effect may be obtained as long as a melting depth is obtained so that the aspect ratio is not less than 0.2, a very large amount of energy is required to form melted and re-solidified layers having such a very large sectional area, and there is a problem in applying an industrial application that a low cost and a high productivity are required. There may also be a problem for increasing a hysteresis loss due to an excessive increase of a melting volume and thus not being able to ensure a large core loss improvement effect.

Further, it may be preferable to form the melted and re-solidified layers having a melting width in the range from not less than approximately 50 μm to 150 μm, an aspect ratio of not less than approximately 0.2 and a melting depth d of more than approximately 15 μm so as to obtain a still larger core loss improvement effect.

In addition, it may be preferable to form the melted and re-solidified layers having a melting width in the range from not less than approximately 60 μm to 100 μm, an aspect ratio of not less than approximately 0.2 and a melting depth d of more than approximately 30 μm on both the surfaces of a steel sheet in the manner of extending in the direction approximately perpendicular to the rolling direction at a constant interval PL of approximately 3 mm in the rolling direction so as to obtain a very large core loss improvement effect exceeding approximately 9% in terms of a core loss improvement rate from the view point of limiting the conditions for improving core loss to the vicinity of the optimum conditions.

As described above, one of the advantages of the present invention is that the core loss improvement rate may exceed the rate obtained by the conventional melted and re-solidified layer method, the mechanical method, the etching method or the laser groove forming method can be obtained by limiting the sectional shape and interval in the rolling direction in the aforementioned ranges in the event of forming the melted and re-solidified layers. Further, according to another exemplary embodiment of the present invention, it is possible to produce an aforementioned steel sheet with a high productivity and at low cost, since only a laser treatment process should be added. Still further, when a continuous oscillation fiber laser is used as a laser device, the width of a melted and re-solidified layer can be reduced, and thus the energy used for the method can also be reduced. Therefore, one of the advantages of the present invention is that the aforementioned steel sheet can be produced with a higher productivity and at lower cost.

What is claimed is:

1. A grain-oriented electrical steel sheet arrangement having particular magnetic properties, comprising:

at least one portion having a core loss property; and one or more linear melted and re-solidified layers provided on one or more of surfaces of the at least one portion that are configured to improve the core loss property, the one or more layers extending in the direction nearly perpendicular to a rolling direction of the steel sheet, and provided on the at least one portion at a predetermined interval in the rolling direction, wherein the one or more layers have the following characteristics:

$d \geqq 15$ μm, $d/W \geqq 0.2$, and $2\ \text{mm} \leqq PL < 5$ mm, wherein W is a width of the one or more layers in the rolling direction at a section thereof, d is a depth of the one or more layers, and PL is an interval of the one or more layers in the rolling direction.

2. A grain-oriented electrical steel sheet arrangement having particular magnetic properties, comprising:

at least one portion having a core loss property; and linear melted and re-solidified layers provided on surfaces of the at least one portion that are configured to improve the core loss property, the layers extending in the direction nearly perpendicular to a rolling direction of the steel sheet, and provided on the at least one portion at a predetermined interval in the rolling direction, wherein the one or more layers have the following characteristics:

$30\ \mu\text{m} \leqq W \leqq 200\ \mu\text{m}$, $d \geqq 15$ μm, $d/W \geqq 0.2$, and $2\ \text{mm} \leqq PL < 5$ mm, wherein W is a width of at least one of the layers in the rolling direction at a section thereof, d is a depth of the layers, and PL is an interval of the layers in the rolling direction.

3. A method for producing a grain-oriented electrical steel sheet having particular magnetic properties, comprising the steps of:

forming one or more melted and re-solidified layers by irradiating a laser beam thereon; and providing the one or more layers on one or more of surfaces of the steel sheet that are configured to improve a core loss property of the steel sheet, the one or more layers extending in the direction nearly perpendicular to a rolling direction of the steel sheet, and provided on the steel sheet at a predetermined interval in the rolling direction, wherein the one or more layers have the following characteristics:

$d \geqq 15$ μm, $d/W \geqq 0.2$, and $2\ \text{mm} \leqq PL < 5$ mm, and wherein W is a width of the one or more layers in the rolling direction at a section thereof, d is a depth of the one or more layers, and PL is an interval of the one or more layers in the rolling direction.

4. The method according to claim 3, wherein the laser beam is radiated from a continuous oscillation fiber laser being utilized as a laser device.

5. A method for producing a grain-oriented electrical steel sheet having particular magnetic properties, comprising the steps of:

forming melted and re-solidified layers by irradiating a laser beam thereon; and providing the layers on surfaces of the steel sheet that are configured to improve a core loss property of the steel sheet, the layers extending in the direction nearly perpendicular to a rolling direction of the steel sheet, and provided on the steel sheet at a predetermined interval in the rolling direction, wherein the one or more layers have the following characteristics:

$d \geqq 15$ μm, $d/W \geqq 0.2$, and $2\ \text{mm} \leqq PL < 5$ mm, and wherein W is a width of the one or more layers in the rolling direction at a section thereof, d is a depth of the one or more layers, and PL is an interval of the one or more layers in the rolling direction.

6. The method according to claim 5, wherein the laser beam is radiated from a continuous oscillation fiber laser being utilized as a laser device.

* * * * *